US009365027B2

(12) United States Patent
Shi

(10) Patent No.: US 9,365,027 B2
(45) Date of Patent: Jun. 14, 2016

(54) SILK-SCREEN PRINTING PLATE

(71) Applicant: BOE TECHNOLOGY GROUP CO., LTD., Beijing (CN)

(72) Inventor: Yue Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 29 days.

(21) Appl. No.: 14/363,143

(22) PCT Filed: May 16, 2013

(86) PCT No.: PCT/CN2013/075714

§ 371 (c)(1),
(2) Date: Jun. 5, 2014

(87) PCT Pub. No.: WO2014/131249

PCT Pub. Date: Sep. 4, 2014

(65) Prior Publication Data

US 2015/0352830 A1 Dec. 10, 2015

(30) Foreign Application Priority Data

Mar. 1, 2013 (CN) ..... 2013 1 0066467

(51) Int. Cl.
*B41F 15/34* (2006.01)
*B41N 1/24* (2006.01)

(52) U.S. Cl.
CPC ..... *B41F 15/34* (2013.01); *B41N 1/247* (2013.01)

(58) Field of Classification Search
CPC ..... B41F 15/34; B41F 15/36; B41F 15/38; B41N 1/247
See application file for complete search history.

(56) References Cited

U.S. PATENT DOCUMENTS

| | | | | |
|---|---|---|---|---|
| 3,871,411 | A * | 3/1975 | Sato et al. | 138/178 |
| 2002/0098314 | A1 | 7/2002 | Uchiyama | |
| 2003/0015107 | A1 * | 1/2003 | Furukawa et al. | 101/143 |

FOREIGN PATENT DOCUMENTS

| | | | |
|---|---|---|---|
| CN | 202669145 | U | 1/2013 |
| JP | 2002-211155 | A | 7/2002 |

OTHER PUBLICATIONS

"Tetrahydrofuran (THF) Storage and Handling" by BASF published in 1998.*
"Polyester|Physical and Chemical Properties of Polyester" by Textile Technologist published on Jun. 26, 2012.*
International Search Report dated Nov. 18, 2013; PCT/CN2013/075714.
Written Opinion of the International Searching Authority dated Nov. 19, 2013; PCT/CN2013/075714.
Renying Zhang; "Several Key Factors of Selection Screen", Screen Print Magazine, vol. 12, Dec. 25, 2012; 4 pages.
First Chinese Office Action dated Jun. 5, 2014; Appln. No. 201310066467.1.

* cited by examiner

*Primary Examiner* — Blake A Tankersley
(74) *Attorney, Agent, or Firm* — Ladas & Parry LLP

(57) ABSTRACT

A silk-screen printing plate is woven by at least two woven fibers, each of which is a polymer fiber or an inorganic fiber. The at least one of the woven fibers is soluble, for example in an organic solvent. The silk-screen printing plate has a varied mesh as the dissolution of the woven fiber(s).

4 Claims, 3 Drawing Sheets

SILK-SCREEN PRINTING PLATE

TECHNICAL FIELD

An embodiment of the present invention relates to a silk-screen printing plate.

BACKGROUND

The silk-screen printing process has been applied to the frame sealant printing of the thin-film transistor-liquid crystal display (TFT-LCD) manufacturing process for many years. This process has the advantages of relatively low equipment investment cost and relatively low technological requirements, as compared to coating the frame sealant with a seal dispenser. Hence, it is currently widely applied in production lines of low-generation liquid crystal panels.

Silk-screen printing plate is a key component for forming a frame sealant in certain width. However, the conventional silk-screen has defined mesh numbers. When relatively low mesh numbers are desired to satisfy the requirement of printing a frame sealant mixed with an oversize spacer, a new silk-screen must be prepared, resulting in the waste of material and inconvenient operation.

SUMMARY

An embodiment of the present invention provides a silk-screen printing plate, comprising at least two woven fibers, wherein, at least one of the woven fibers is soluble, such that the silk-screen printing plate will have a reduced mesh as the dissolution of the woven fiber(s).

For instance, in the embodiment of the present invention, each woven fiber is a polymer fiber or an inorganic fiber.

For instance, in the embodiment of the present invention, the silk-screen printing plate comprises three woven fibers, in which two of the woven fibers are soluble in different solvents.

For instance, in the embodiment of the present invention, the solvent can be selected from the group consisting of cyclohexanone, tetrahydrofuran, xylene, dimethylformamide (DMF), and solvents having similar properties with the above solvents.

For instance, in the embodiment of the present invention, the three woven fibers are nylon, a polyethylene fiber, and a glass fiber, respectively, in which the nylon is soluble in a cyclohexanone solvent, and the polyethylene fiber is soluble in a tetrahydrofuran solvent.

For instance, in the embodiment of the present invention, the three woven fibers are nylon, a polyethylene fiber, and a carbon fiber, respectively, in which the nylon is soluble in a cyclohexanone solvent, and the polyethylene fiber is soluble in a tetrahydrofuran solvent.

For instance, in the embodiment of the present invention, the three woven fibers are nylon, a polyethylene fiber, and a Kevlar fiber, respectively, in which the nylon is soluble in a cyclohexanone solvent, and the polyethylene fiber is soluble in a tetrahydrofuran solvent.

For instance, in the embodiment of the present invention, the three woven fibers are a polypropylene fiber, a polyurethane fiber, and a Kevlar fiber, respectively, in which the polypropylene fiber is soluble in a xylene solvent, and the polyurethane fiber is soluble in a DMF solvent.

BRIEF DESCRIPTION OF THE DRAWINGS

The figures of the examples will be simply described in order to illustrate the embodiments of the present invention more clearly. It is apparent that the described figures represent only a portion of the examples of the present invention, rather than limiting the scope of the invention.

DETAILED DESCRIPTION

The embodiments of the present invention will be described clearly and completely hereinafter. It is apparent that the described embodiments represent only a portion of, rather than all of the embodiments of the present invention. Based on the embodiments of the present invention, persons of ordinary skill in the art can obtain other embodiments without creative work, all of which are encompassed within the present invention.

Figure 1:
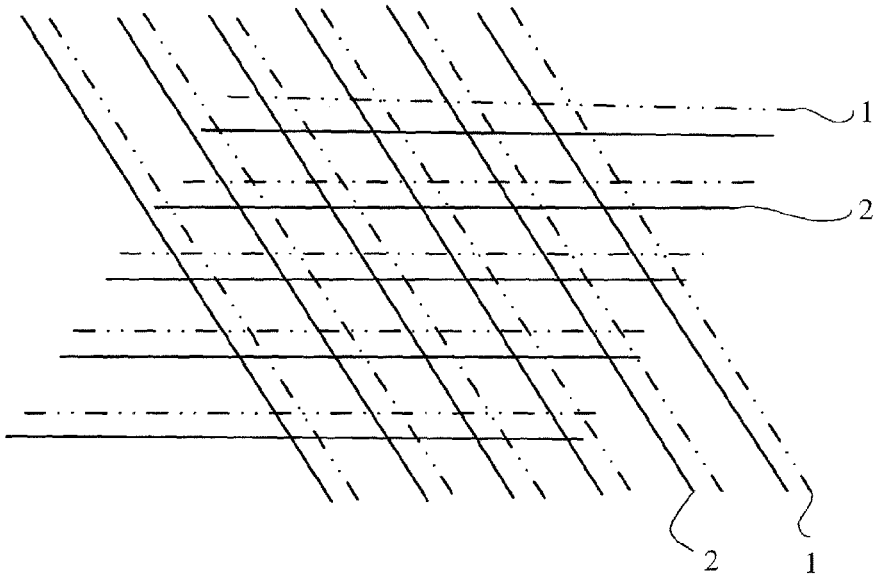
FIG. 1 is a silk-screen printing plate provided by an embodiment of the present invention.

The embodiment of the present invention provides a silk-screen printing plate. As illustrated in FIG. 1, the silk-screen printing plate comprises two woven fibers, namely, is formed by weaving the two woven fibers, the two woven fibers being a first fiber 1 and a second fiber 2. At least one of the woven fibers 1 and 2 is soluble, for example, in an organic solvent.

For instance, as illustrated in FIG. 1, the silk-screen printing plate woven by the two fibers is a 200 mesh one. The silicon balls mixed in a frame sealant that can be printed by the silk-screen printing plate have a size of 3 to 6 μm, for example, 3 μm, 3.5 μm, 4 μm, 4.5 μm, 5 μm, 5.5 μm, 6 μm, and 7.5 μm. The corresponding liquid crystal cell has a thickness of 3 to 8 μm, for example, 3 μm, 3.5 μm, 4 μm, 4.5 μm, 5 μm, 5.5 μm, 6 μm, 6.5 μm, 7 μm, 7.5 μm, and 8 μm.

The silk-screen printing plate provided by the embodiments of the present invention can be applied to frame sealant printing. The silk-screen printing plate is formed by two woven fibers, wherein, one of the woven fibers is soluble, for example, in an organic solvent, namely, the silk-screen printing plate has a mesh that can be changed through the dissolution of the woven fiber, as compared to the traditional silk-screen printing plate. When display panels corresponding to printing have consistent dimensions and have consistent arrangement on a glass substrate, the mesh of the silk-screen printing plate can be reduced through the dissolution of one woven fiber to produce the silk-screen printing plate as desired by the silk-screen printing process.

Therefore, the embodiment of the present invention provides a silk-screen printing plate, of which the mesh can be reduced according to printing needs with an easy operation.

Moreover, each of the woven fibers can be a polymer fiber or an inorganic fiber. The basic component of the polymer fiber is a polymer or a material which possesses the properties of a polymer contained therein as main characteristics thereof, such as, rubber, a fiber, plastics, a polymeric adhesive, a polymer coating, and a polymer-based composite material. The inorganic fiber is a chemical fiber made by taking minerals as a raw material, comprising without limitation a glass fiber, a quartz glass fiber, a boron fiber, a ceramic fiber, a metal fiber, and the like.

When the silk-screen printing plate is formed by weaving, the two woven fibers are alternately woven in warp direction and weft direction, such that the woven structure of the silk-screen printing plate can be maintained with reduced mesh after the soluble woven fiber is dissolved. The weaving structure of the at least two woven fibers can be any one conventionally used in the field of silk-screen printing plate. For instance, the silk-screen printing plate can be formed by the at least two woven fibers in plain weave, twill weave, full twist weave, half twist weave, and the like.

Figure 3:
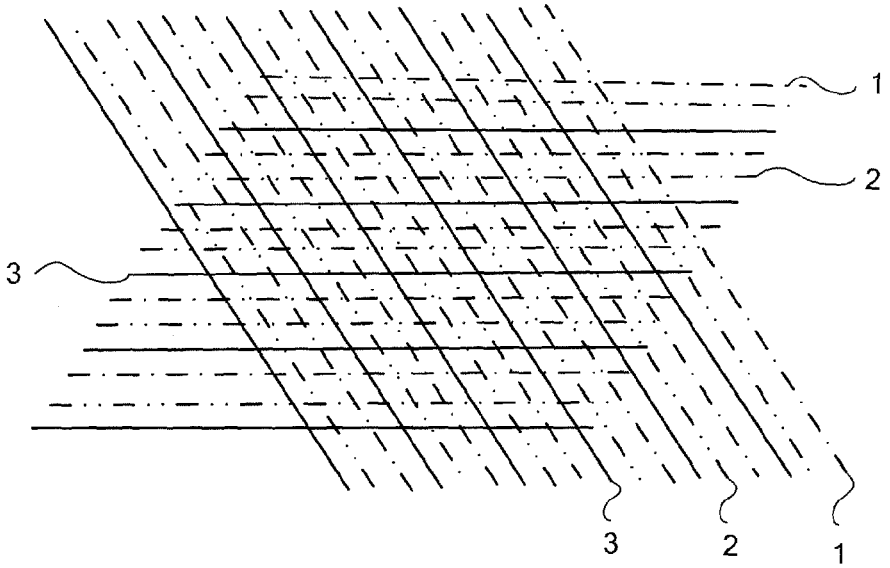
FIG. 3 is a silk-screen printing plate provided by an embodiment of the present invention.

Moreover, in another embodiment, the silk-screen printing plate comprises three woven fibers, namely, the silk-screen printing plate is formed by the three woven fibers. As illustrated in FIG. 3, the three woven fibers comprise a first fiber 1, a second fiber 2, and a third fiber 3, respectively, wherein two woven fibers are dissolved in different solvents, for instance, in an organic solvent.

For instance, as illustrated in FIG. 3, the silk-screen printing plate woven by the three polymer fibers or inorganic fibers is a 300 mesh one. The silicon balls mixed in a frame sealant that can be printed by the silk-screen printing plate have a size of 3 to 6 μm, for example, 3 μm, 3.5 μm, 4 μm, 4.5 μm, 5 μm, 5.5 μm, and 6 μm. The corresponding liquid crystal cell has a thickness of 3 to 8 μm, for example, 3 μm, 3.5 μm, 4.5 μm, 5 μm, 5.5 μm, 6 μm, 6.5 μm, 7 μm, 7.5 μm, and 8 μm.

The woven fibers can be dissolved in the solvent by immersing into the solvent, or can be dissolved by a steam treatment from the corresponding solvent.

All of the above three woven fibers can be polymer fibers or inorganic fibers, or one or two of them are polymer fibers and the remaining two or one are inorganic fibers. No further description will be given here.

When the silk-screen printing plate is formed by weaving, the three woven fibers are arranged sequentially to form a group of fibers, and the silk-screen printing plate is obtained by weaving a plurality of fiber groups in warp direction and weft direction. Therefore, each fiber occurs periodically in warp direction and weft direction, such that the woven structure of the silk-screen printing plate can be maintained with reduced mesh after the soluble woven fiber is dissolved. The weaving structure of the fiber groups can be any one conventionally used in the field of silk-screen printing plate. For instance, the silk-screen printing plate can be formed in plain weave, twill weave, full twist weave, half twist weave, and the like.

The figures only illustrate weaving portions of the silk-screen printing plate. The weaving portions are, for instance, fixed on a frame.

Example 1

In two woven fibers of a silk-screen printing plate provided by the example, as illustrated in FIG. 1, the first fiber 1 is nylon and the second fiber 2 is a carbon fiber, wherein the nylon is soluble in a cyclohexanone solvent. The first fiber 1 and the second fiber 2 are alternately arranged in warp direction and weft direction and woven to form the silk-screen printing plate.

Cyclohexanone is an important chemical raw material useful for an intermediate for preparing nylon, caprolactam, and adipate, and is also an important industrial solvent.

Figure 2:
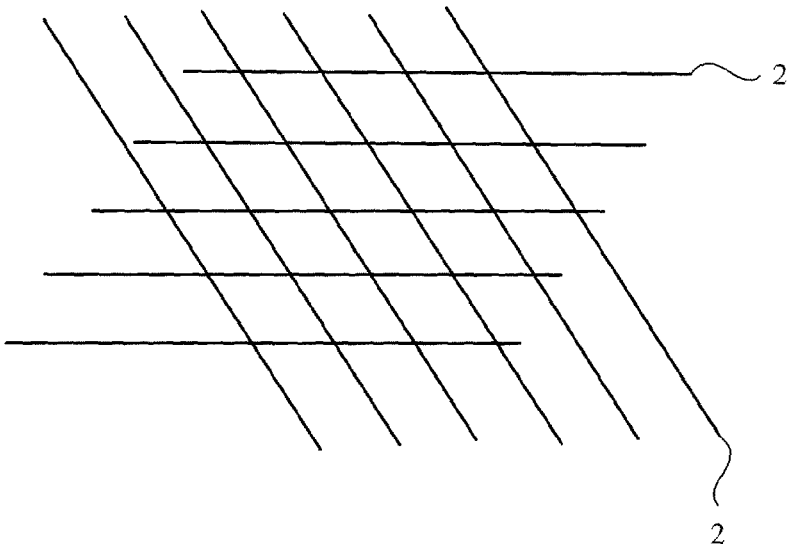
FIG. 2 is a low-mesh silk-screen printing plate obtained after treating the silk-screen printing plate as shown in FIG. 1.

The silk-screen printing plate as shown in FIG. 1 has a mesh of 200. If a 100-mesh printing plate is desired, the silk-screen printing plate can be soaked in cyclohexanone for 50 to 70 minutes. After the first fiber 1 (nylon) is dissolved in the cyclohexanone solvent, the second fiber 2 (carbon fiber) is left over. Then, the silk-screen printing plate is removed. As illustrated in FIG. 2, the remaining second fibers 2 are still woven into the silk-screen printing plate, such that a 100-mesh silk-screen printing plate can be obtained.

Example 2

In three woven fibers of a silk-screen printing plate provided by the example, as illustrated in FIG. 3, the first fiber 1 is nylon, the second fiber 2 is a polyethylene fiber, and the third fiber 3 is a glass fiber, wherein the nylon is soluble in a cyclohexanone solvent and the polyethylene fiber is soluble in a tetrahydrofuran solvent. The first fiber 1, the second fiber 2, and the third fiber 3 are arranged sequentially to form a group of fibers, and the silk-screen printing plate is obtained by weaving a plurality of fiber groups in warp direction and weft direction. Therefore, each fiber occurs periodically in warp direction and weft direction.

Tetrahydrofuran is a heterocyclic organic compound, which is one of the most polar ethers, and used as a solvent with medium polarity in chemical reaction and extraction.

Figure 4:
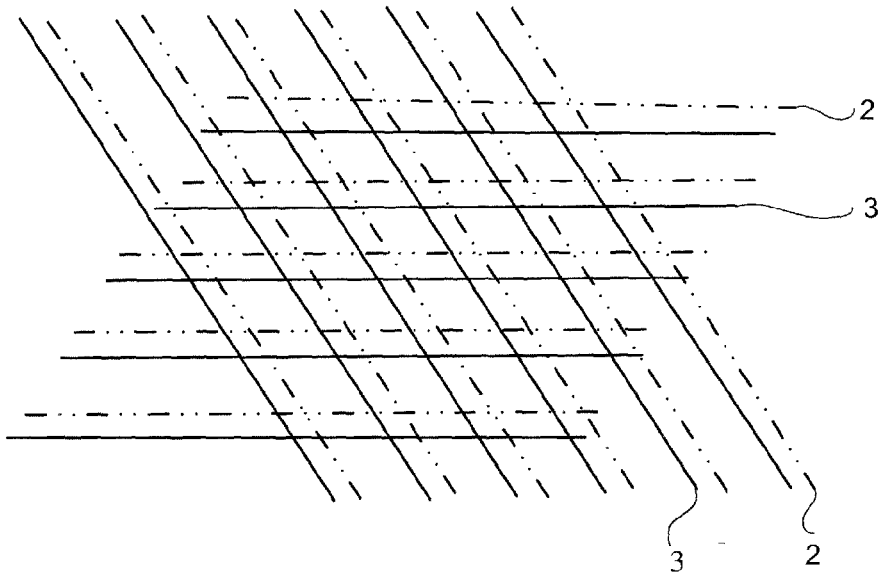
FIG. 4 is a low-mesh silk-screen printing plate obtained after treating the silk-screen printing plate as shown in FIG. 3.
Figure 5:
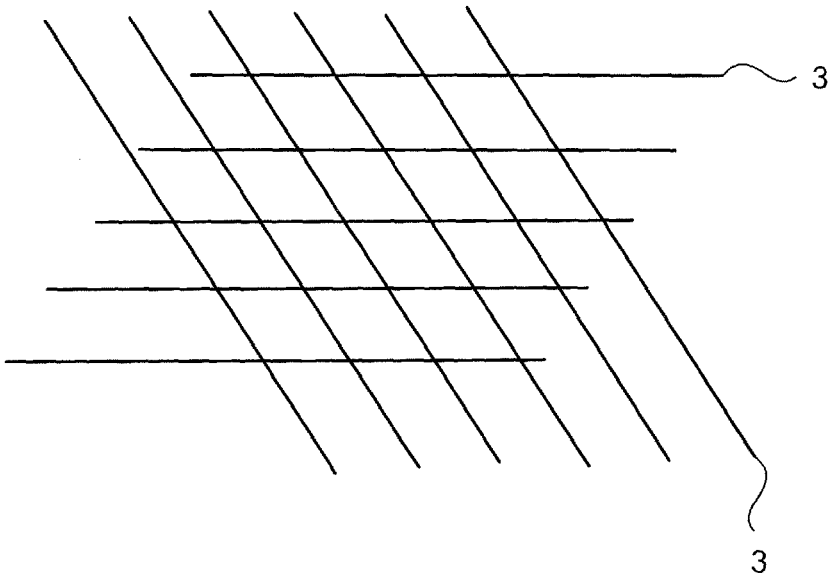
FIG. 5 is a low-mesh silk-screen printing plate obtained after treating the silk-screen printing plate as shown in FIG. 4.

The silk-screen printing plate as shown in FIG. 3 has a mesh of 300. If a 200-mesh printing plate is desired, the silk-screen printing plate can be soaked in cyclohexanone for 50 to 70 minutes. Then, the silk-screen printing plate is removed. The first fiber 1 (nylon) has been dissolved in the cyclohexanone solvent, and the second fiber 2 (carbon fiber) and the third fiber 3 (glass fiber) are left over. As illustrated in FIG. 4, a 200-mesh silk-screen printing plate can be formed. If a 100-mesh silk-screen printing plate is further desired, the 200-mesh silk-screen printing plate after the above treatment can be soaked in a tetrahydrofuran solvent for 60 to 80 minutes. After that, the second fiber 2 (polyethylene fiber) will be dissolved, and only the third fiber 3 (glass fiber) is left over. As illustrated in FIG. 5, a 100-mesh silk-screen printing plate can be formed.

Example 3

In three woven fibers of a silk-screen printing plate provided by the example, as illustrated in FIG. 3, the first fiber 1 is nylon, the second fiber 2 is a polyethylene fiber, and the third fiber 3 is a glass fiber, wherein the nylon is soluble in a cyclohexanone solvent and the polyethylene fiber is soluble in a tetrahydrofuran solvent. The first fiber 1, the second fiber 2, and the third fiber 3 are arranged sequentially to form a group of fibers, and the silk-screen printing plate is obtained by weaving a plurality of fiber groups in warp direction and weft direction. Therefore, each fiber occurs periodically in warp direction and weft direction.

The silk-screen printing plate as shown in FIG. 3 has a mesh of 300. If a 200-mesh printing plate is desired, the silk-screen printing plate can be soaked in cyclohexanone for 50 to 70 minutes. Then, the silk-screen printing plate is removed. The first fiber 1 (nylon) has been dissolved in the cyclohexanone solvent, and the second fiber 2 (carbon fiber) and the third fiber 3 (glass fiber) are left over. As illustrated in FIG. 4, a 200-mesh silk-screen printing plate can be formed. If a 100-mesh silk-screen printing plate is further desired, the 200-mesh silk-screen printing plate after the above treatment can be soaked in a tetrahydrofuran solvent for 60 to 80 minutes. After that, the second fiber 2 (polyethylene fiber) will be dissolved, and only the third fiber 3 (glass fiber) is left over. As illustrated in FIG. 5, a 100-mesh silk-screen printing plate can be formed.

Example 4

In three woven fibers of a silk-screen printing plate provided by the example, as illustrated in FIG. 3, the first fiber 1 is nylon, the second fiber 2 is a polyethylene fiber, and the third fiber 3 is a Kevlar fiber (poly-p-phenylene terephthalamide), wherein the nylon is soluble in a cyclohexanone solvent and the polyethylene fiber is soluble in a tetrahydrofuran solvent. The first fiber 1, the second fiber 2, and the third fiber 3 are arranged sequentially to form a group of fibers, and the silk-screen printing plate is obtained by weaving a plurality of fiber groups in warp direction and weft direction. Therefore, each fiber occurs periodically in warp direction and weft direction.

The silk-screen printing plate as shown in FIG. 3 has a mesh of 300. If a 200-mesh printing plate is desired, the silk-screen printing plate can be soaked in cyclohexanone for 50 to 70 minutes. Then, the silk-screen printing plate is removed. The first fiber 1 (nylon) has been dissolved in the cyclohexanone solvent, and the second fiber 2 (carbon fiber) and the third fiber 3 (Kevlar fiber) are left over. As illustrated in FIG. 4, a 200-mesh silk-screen printing plate can be formed. If a 100-mesh silk-screen printing plate is further desired, the 200-mesh silk-screen printing plate after the above treatment can be soaked in a tetrahydrofuran solvent for 60 to 80 minutes. After that, the second fiber 2 (polyethylene fiber) will be dissolved, and only the third fiber 3 (Kevlar fiber) is left over. As illustrated in FIG. 5, a 100-mesh silk-screen printing plate can be formed.

Example 5

In three woven fibers of a silk-screen printing plate provided by the example, as illustrated in FIG. 3, the first fiber 1 is a polypropylene fiber, the second fiber 2 is a polyurethane fiber, and the third fiber 3 is a Kevlar fiber, wherein the polypropylene fiber is soluble in a xylene solvent and the polyurethane fiber is soluble in a DMF solvent. The first fiber 1, the second fiber 2, and the third fiber 3 are arranged sequentially to form a group of fibers, and the silk-screen printing plate is obtained by weaving a plurality of fiber groups in warp direction and weft direction. Therefore, each fiber occurs periodically in warp direction and weft direction.

Xylene is a transparent colorless liquid, and is a product formed by substituting methyl groups for two hydrogen atoms on a benzene ring, which has three isomers, i.e., o-isomer, m-isomer, and p-isomer. Xylene refers to a mixture of the three isomers in industry.

DMF is a transparent liquid, can be miscible with water and most organic solvents, and is a common solvent used in chemical reaction.

The silk-screen printing plate as shown in FIG. 3 has a mesh of 300. If a 200-mesh printing plate is desired, the silk-screen printing plate can be soaked in xylene and heated for 110 to 130 minutes. Then, the silk-screen printing plate is removed. The first fiber 1 (polypropylene fiber) has been dissolved in the xylene solvent, and the second fiber 2 (polyurethane fiber) and the third fiber 3 (Kevlar fiber) are left over. As illustrated in FIG. 4, a 200-mesh silk-screen printing plate can be formed. If a 100-mesh silk-screen printing plate is further desired, the 200-mesh silk-screen printing plate after the above treatment can be soaked in a DMF solvent for 130 to 170 minutes. After that, the second fiber 2 (polyurethane fiber) will be dissolved, and only the third fiber 3 (Kevlar fiber) is left over. As illustrated in FIG. 5, a 100-mesh silk-screen printing plate can be formed.

The examples of the present invention are not limited thereto. The silk-screen printing plate provided by the embodiments of the present invention can also comprise more than three woven fibers. The woven fibers are alternately woven to foil the silk-screen printing plate, wherein at least one of the woven fibers is soluble, for instance, in an organic solvent.

When the silk-screen printing plate is formed by weaving, the more than three woven fibers are arranged sequentially to form a group of fibers, and the silk-screen printing plate is obtained by weaving a plurality of fiber groups in warp direction and weft direction. Therefore, each fiber occurs periodically in warp direction and weft direction. A silk-screen printing plate with desired mesh number can be obtained by dissolving one or more woven fibers in a proper solvent. Persons skilled in the art can easily select a proper solvent based on the type of the fibers used.

It should be understood that the soaking time of the silk-screen printing plate in various solvents is not limited to the periods of time listed above. If the concentration of the solvent is different, the dissolution time will also vary. For instance, the dissolution time may be within an range of 30 to 200 minutes, including every value within the range.

Obviously, various modifications and variants can be made to the embodiments of the present invention by those skilled in the art without departing from the spirit and scope of the present invention. Therefore, if the modifications and variants of the present invention fall within the scope of the appended claims of the present invention and equivalents thereof, the present invention is also intended to cover such modifications and variants.

The invention claimed is:

1. A silk-screen printing plate, comprising three woven fibers, wherein, two of the three woven fibers are soluble in different solvents, such that the silk-screen printing plate will have a reduced mesh when two of the three woven fibers are dissolved;

wherein the three woven fibers are nylon, a polyethylene fiber, and a glass fiber, respectively, and at least one of the different solvents is selected from the group consisting of cyclohexanone, tetrahydrofuran, xylene, and dimethylformamide; and wherein, the nylon is soluble in a cyclohexanone solvent, and the polyethylene fiber is soluble in a tetrahydrofuran solvent.

2. A silk-screen printing plate, comprising three woven fibers, wherein, two of the three woven fibers are soluble in different solvents, such that the silk-screen printing plate will have a reduced mesh when two of the three woven fiber are dissolved;

wherein the three woven fibers are nylon, a polyethylene fiber, and a carbon fiber, respectively, and at least one of the different solvents is selected from the group consisting of cyclohexanone, tetrahydrofuran, xylene, and dimethylformamide; and wherein the nylon is soluble in a cyclohexanone solvent, and the polyethylene fiber is soluble in a tetrahydrofuran solvent.

3. A silk-screen printing plate, comprising three woven fibers, wherein, two of the three woven fibers are soluble in different solvents, such that the silk-screen printing plate will have a reduced mesh when two of the three woven fibers are dissolved;

wherein the three woven fibers are nylon, a polyethylene fiber, and a Kevlar fiber, respectively, and at least one of the different solvents is selected from the group consisting of cyclohexanone, tetrahydrofuran, xylene, and dimethylformamide; and wherein the nylon is soluble in a cyclohexanone solvent, and the polyethylene fiber is soluble in a tetrahydrofuran solvent.

4. A silk-screen printing plate, comprising three woven fibers, wherein, two of the three woven fibers are soluble in different solvents, such that the silk-screen printing plate will have a reduced mesh when two of the three woven fibers are dissolved;

wherein the three woven fibers are a polypropylene fiber, a polyurethane fiber, and a Kevlar fiber, respectively, and at least one of the different solvents is selected from the group consisting of cyclohexanone, tetrahydrofuran, xylene, and dimethylformamide; and wherein the polypropylene fiber is soluble in a xylene solvent, and the polyurethane fiber is soluble in a dimethylformamide solvent.

* * * * *